United States Patent [19]

Cashmere

[11] Patent Number: 4,538,540

[45] Date of Patent: Sep. 3, 1985

[54] HULL CONSTRUCTION

[76] Inventor: Raymond Cashmere, 42 Kulai St., Charlestown, New South Wales 2290, Australia

[21] Appl. No.: 580,942

[22] Filed: Feb. 16, 1984

[30] Foreign Application Priority Data

Feb. 21, 1983 [AU] Australia ..... PF8117

[51] Int. Cl.[3] ..... B63B 1/32

[52] U.S. Cl. ..... 114/288; 441/74

[58] Field of Search ..... 441/65, 68, 74, 73, 441/72, 67; 114/61, 56, 57, 288, 289, 290, 291, 283, 292, 271, 62, 355–358; D21/228, 229; 280/601, 602, 609

[56] References Cited

U.S. PATENT DOCUMENTS 3,208,421 9/1965 Landes et al. ..... 114/290
3,289,227 12/1966 Kelly ..... 441/74
3,323,154 6/1967 Lambach ..... 441/74
3,827,096 8/1974 Brownson ..... 441/68
3,902,445 9/1975 Stolk ..... 114/289

FOREIGN PATENT DOCUMENTS 941399 2/1974 Canada ..... 441/68
2842675 4/1980 Fed. Rep. of Germany ..... 441/74

*Primary Examiner*—Jesus D. Sotelo
*Attorney, Agent, or Firm*—Oblon, Fisher, Spivak, McClelland & Maier

[57] ABSTRACT

A hull construction for a board useful in water sports, and a board incorporating such a hull, the hull incorporating a pair of air intake chambers extending from the forward end thereof, in the nature of parallel grooves which are mirror images of each other in the axis of symmetry of the hull, to beyond the hull center in the direction of the following end of the hull, a pair of following end grooved vacuum chambers and a strip of ungrooved hull between the ends of the air intake chambers and the vacuum chambers.

8 Claims, 8 Drawing Figures

HULL CONSTRUCTION

BACKGROUND OF THE INVENTION

1. Field of the Invention

This invention relates to hull constructions and more particularly to the construction of the hulls of such pleasure and sporting equipment as water toboggans, knee boards, surfboards, surfskis, sailboards and water skis.

2. Description of the Prior Art

Equipment of the kind specified has been most popular with water sports enthusiasts for many years. Various attempts have been made to optimize manoeuvrability of such equipment. Most such attempts have centred on overall article shape and material of construction. In the case of surfboards, for example, experiments with one or more fins have been evidenced and the lengths and weights of boards have decreased dramatically in recent times.

Until recently little or no attention has been paid to the construction and contouring of the hull surface. Most recent hull constructions have incorporated a plurality of parallel grooves extending over all or most of the hull surface, each groove being parallel to the axis of symmetry on the board itself. Such constructions offer some improvement in board maneuverability but problems still arise in that, for example, it is difficult to complete a 360° turn on such a board when towed by a speedboat.

SUMMRY OF THE INVENTION

It is an object of this invention to provide hull constructions which offer improved maneuverability in boards used for the above specified purposes.

The invention in one broad form provides a hull construction incorporating:

(a) a pair of air intake chambers one on either side of the longitudinal axis of symmetry of the hull and symmetrical thereabout each said air intake chamber having a mouth at the forward end of the hull and being constituted by a longitudinal groove in the hull surface each said groove extending longitudinally of the hull towards the following end thereof, generally decreasing in cross-section towards said following end and extending over more than half the hull length;

(b) a pair of vacuum chambers at the following end of the hull one on either side of the longitudinal axis of symmetry of the hull and symmetrical thereabout, each said vacuum chamber being constituted, by a groove in the hull surface, each said groove extending longitudinally of the hull from the following end towards the forward end thereof and terminating in an arc; and (c) a section of ungrooved hull surface between the respective ends of the air intake chambers and the vacuum chambers.

It is preferred that further grooves are cut in the periphery of the hull to provide a sharp arc at the hull perimeter so that, when a rider tilts a board incorporating such a hull, a sharper turn may be performed than in a conventional board with an ungrooved hull.

The current invention is applicable to a large number of boards as indicated above. Such boards vary in length to suit particular purposes. In approximate terms a board useful as a water toboggan or knee board, useful for riding whilst being drawn by a powered boat would be twice as long as its width. A surfboard might be three times as long as wide, a surf ski four times as long as wide, a sailboard five times or more as long as wide and a water ski six times as long as wide.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 4:
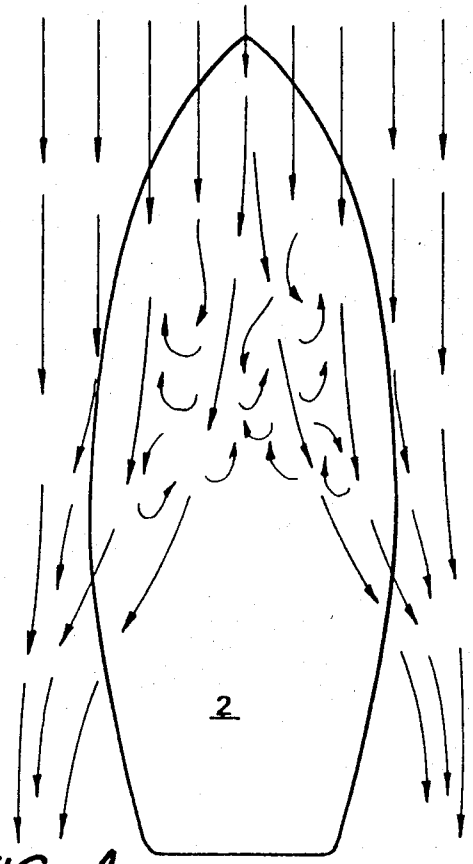
FIG. 4 PRIOR ART
FIG. 4 depicts an air/water flow pattern relative to a conventional hull.

In the drawings, hull 1 of this invention may be compared with hull 2 of a conventional ungrooved contour (FIG. 4). Hull 1 incorporates grooved air intake chambers 3A, 3B which extend from forward end 4 of hull 1 longitudinally towards following end 5 of hull 1 and terminate in arcs 6A,6B. Chambers 3A and 3B are mirror images of each other in the axis of symmetry 10 of hull 1. Chambers 3A and 3B have comparatively wide mouths 7A,7B and narrow over their lengths to arcs 6A,6B.

Vacuum chambers 8A,8B are grooved portions of hull 1 located at following end 5 thereof. Chambers 8A,8B extend towards forward end 4 of hull 1 and end in arcs 9A,9B. The inner edges of chambers 8A and 8B coincide with each other and axis of symmetry 10 of hull 1.

An ungrooved planing region 11 remains between chambers 3A and 3B on the one hand and chambers 8A and 8B on the other. Planing region 11 extends across the width of hull 1 and, in the direction of the axis of symmetry 10 of hull 1, occupies a comparatively small region.

Figure 2:
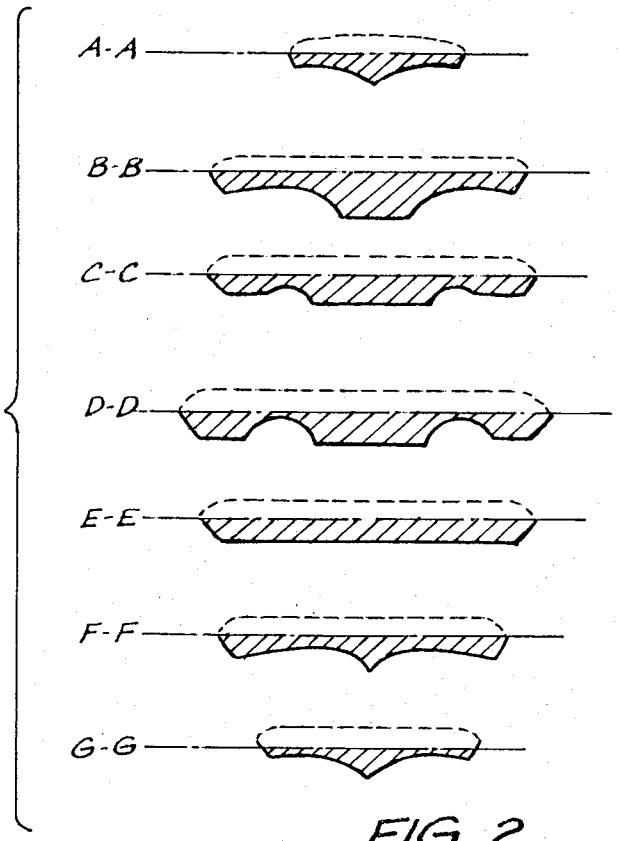
FIG. 2 depicts a series of sections of the hull of FIG. 1 on the lines A—A, B—B, C—C, D—D, E—E, F—F and G—G as indicated.
Figure 1:
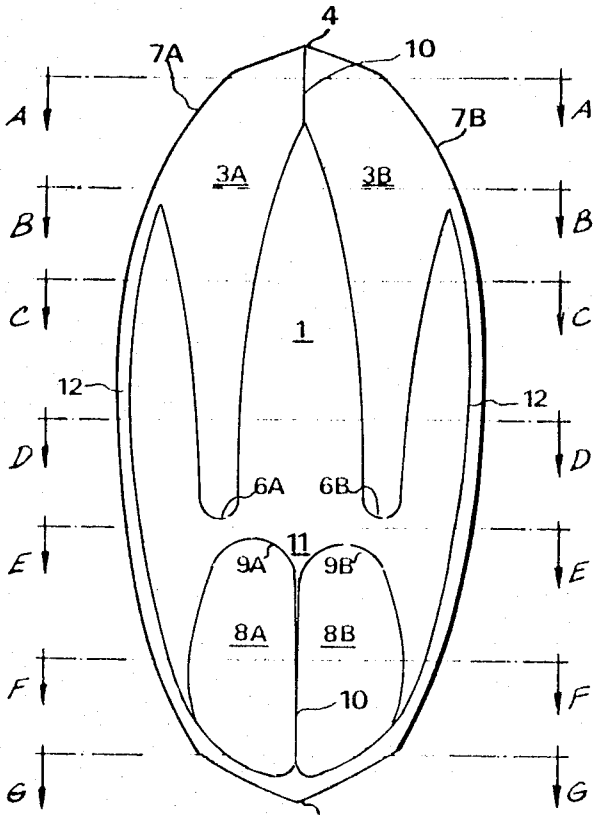
FIG. 1 depicts a hull according to this invention.

FIG. 1 depicts a hull useful in such articles as a water toboggan or kneeboard wherein the ratio of hull length to hull width approximates 2:1. In this board it is useful to incorporate an angled peripheral surface 12. This region is provided so that when a rider tilts the board a sharp surface is presented to the water and a sharper turn than with a conventional board having an ungrooved periphery is available. This particularly assists in performance of 360° turns. The peripheral groove may be incorporated in the hull of any board according to this invention.

Figure 3:
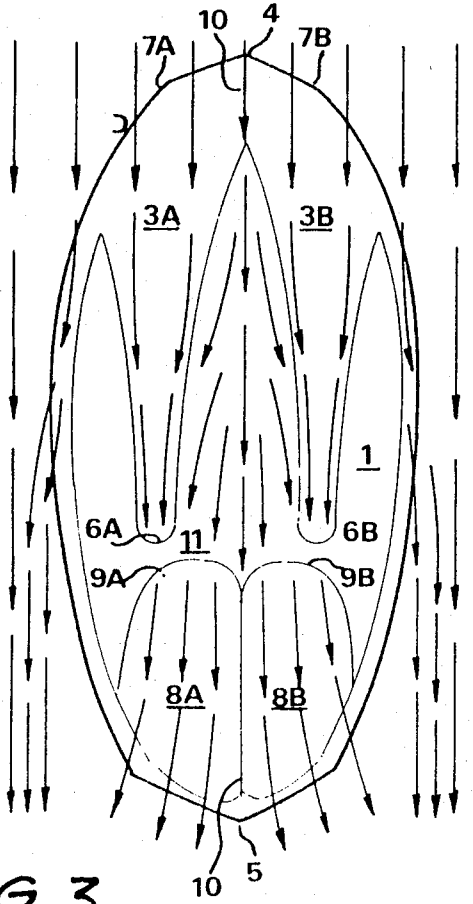
FIG. 3 depicts an air/water flow pattern relative to a hull of this invention.

FIG. 3 (this invention) and FIG. 4 (prior art) include arrows indicating air/water flow in the region of a board having a hull according to this invention compared with the prior art hull. It is apparent that the hull of this invention obviates difficulties which arise from conventional hull shapes wherein an area of turbulence is encountered in the hull centre about one-third of the length of the board from forward to following end.

Figure 5:
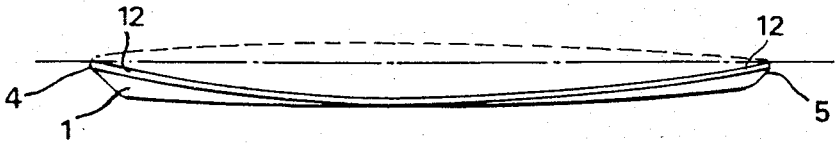
FIG. 5 is a side view of a board incorporating a hull of this invention.

FIG. 5 depicts a board incorporating a hull according to FIG. 1 and illustrates, in particular angled peripheral surface 12.

Figure 6:
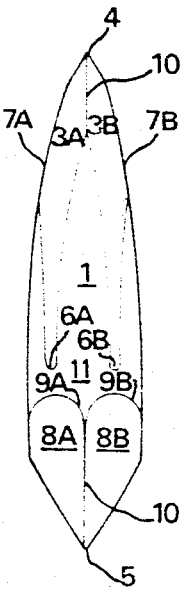
FIGS. 6, 7 and 8 depict boards of varying lengths incorporating hulls of this invention, these boards being useful for differing purposes.
Figure 7:
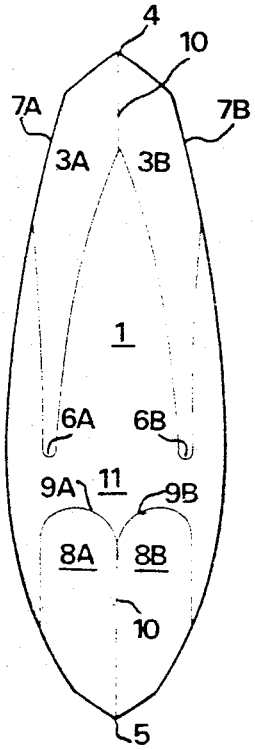
Figure 8:
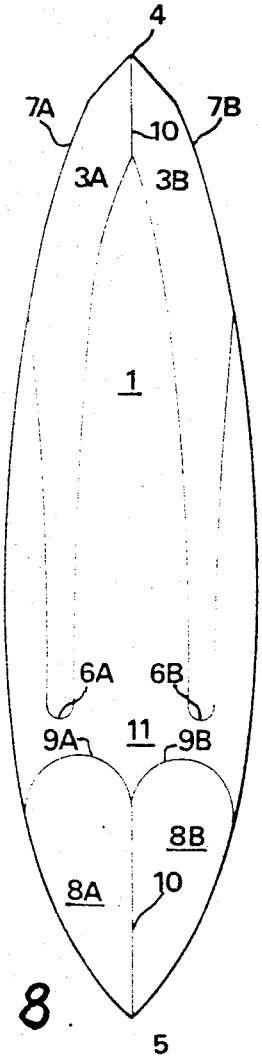

FIGS. 6, 7 and 8 illustrate hulls of varying lengths and widths, which hulls fall within the scope of this invention. In FIG. 6 the length to breadth ratio is approximately 2:4, in FIG. 7 approximately 3 and in FIG. 8 approximately 4.

Obviously, numerous modifications and variations of the present invention are possible in light of the above teachings. It is therefore to be understood that within the scope of the appended claims, the invention may be practiced otherwise than as specifically described herein.

What I claim is:

1. A hull construction incorporating:

a pair of air intake chambers one on either side of the longitudinal axis of symmetry of the hull and symmetrical thereabout each said air intake chamber having a mouth at the forward end of the hull and being constituted by a longitudinal groove in the hull surface each said groove extending longitudinally of the hull towards the following end thereof, generally decreasing in cross-section towards the said following end and extending over more than half the hull length, a pair of vacuum chambers at the following end of the hull one on either side of the longitudinal axis of symmetry of the hull and symmetrical thereabout, each said vacuum chamber being constituted by a groove in the hull surface, each said groove extending longitudinally of the hull from the following end towards the forward end thereof and terminating in an arc; and a section of ungrooved hull surface between the respective ends of the air intake chambers and the vacuum chambers.

2. A hull as defined in claim 1 further including a angled peripheral surface.

3. A hull as defined in claim 1 or claim 2 wherein the inner edges of the intake chambers coincide on the axis of symmetry of said hull.

4. A hull construction incorporating:

a pair of air intake chambers one on either side on the axis of symmetry of the hull and symmetrical thereabout, each said air intake chamber having a mouth at the forward end of the hull and being constituted by a longitudinal groove in the hull surface each said groove extending longitudinally of the hull towards the following end thereof, generally decreasing in cross-section towards the said following end and extending over more than half the hull length;

a pair of vacuum chambers at the following end of the hull one on either side of the axis of symmetry of the hull and symmetrical thereabout, each said vacuum chamber being constituted by a groove in the hull surface, each said groove extending longitudinally of the hull from the following end towards the forward end thereof and terminating in an arc, the inner edges of said vacuum chambers coinciding on the axis of symmetry of the hull; and a section of ungrooved hull surface between the respective ends of the air intake chambers and the vacuum chambers.

5. A hull as defined in claim 4, wherein said hull further comprises an angled peripheral surface.

6. A hull as defined in claim 4, wherein the inner edges of the intake chambers coincide on the axis of symmetry of said hull.

7. A hull as defined in claim 4, wherein the average widths of the vacuum chambers are greater than the average widths of the air intake chambers and extend substantially across the breadth of the following end of the hull.

8. A hull as defined in claim 4, wherein the ratio of the length to breadth of the hull is 2:1 or greater.

* * * * *

UNITED STATES PATENT AND TRADEMARK OFFICE

CERTIFICATE OF CORRECTION

PATENT NO. : 4,538,540

DATED : September 3, 1985

INVENTOR(S) : Cashmere Raymond

It is certified that error appears in the above-identified patent and that said Letters Patent is hereby corrected as shown below:

On the title page:

The assignee should read as follows:

-- [73] Assignee: ADVENTURE PLASTICS PTY. LTD.
New South Wales, Australia --.

Signed and Sealed this

*Twenty-fifth* Day of *February 1986*

[SEAL]

*Attest:*

DONALD J. QUIGG

*Attesting Officer*

*Commissioner of Patents and Trademarks*